US011359809B2

(12) United States Patent
Paniagua et al.

(10) Patent No.: US 11,359,809 B2
(45) Date of Patent: Jun. 14, 2022

(54) INFRARED RADIATOR AND METHOD OF ASSEMBLING SAME

(71) Applicant: VOITH PATENT GMBH, Heidenheim (DE)

(72) Inventors: Juan Paniagua, Moenchengladbach (DE); Dirk Hoeckelmann, Moenchengladbach (DE)

(73) Assignee: Voith Patent GmbH, Heidenheim (DE)

( * ) Notice: Subject to any disclaimer, the term of this patent is extended or adjusted under 35 U.S.C. 154(b) by 358 days.

(21) Appl. No.: 16/609,033

(22) PCT Filed: Feb. 19, 2018

(86) PCT No.: PCT/EP2018/053994

§ 371 (c)(1),
(2) Date: Oct. 28, 2019

(87) PCT Pub. No.: WO2018/197070

PCT Pub. Date: Nov. 1, 2018

(65) Prior Publication Data

US 2020/0096193 A1 Mar. 26, 2020

(30) Foreign Application Priority Data

Apr. 28, 2017 (DE) ..... 10 2017 109 152.1

(51) Int. Cl.

| | |
|---|---|
| ***F23D 14/12*** | (2006.01) |
| ***F23D 99/00*** | (2010.01) |
| ***F23D 14/14*** | (2006.01) |

(52) U.S. Cl.

CPC ..... *F23D 14/125* (2013.01); *F23D 14/14* (2013.01); *F23D 91/02* (2015.07); *F23D 14/149* (2021.05);

(Continued)

(58) Field of Classification Search

CPC .. F23D 14/149; F23D 14/14; F23D 2203/005; F23D 2212/005; F23D 2212/103; F23D 2213/00

(Continued)

(56) References Cited

U.S. PATENT DOCUMENTS 1,775,050 A * 9/1930 Pink ..... B65G 15/54 245/10

1,965,542 A 7/1934 Colvin (Continued)

FOREIGN PATENT DOCUMENTS

| | | | |
|---|---|---|---|
| AU | 2007201291 | A1 | 10/2008 |
| DE | 102016217490 | A1 | 1/2017 |
| EP | 2292817 | A1 | 3/2011 |

*Primary Examiner* — Avinash A Savani

(74) *Attorney, Agent, or Firm* — Laurence A. Greenberg; Werner H. Stemer; Ralph E. Locher

(57) ABSTRACT

An infrared radiator for the heat treatment of a material web has an incandescent body with a flow-receiving surface that is subjected to a flow of a gas-air mixture supplied to the infrared radiator and heated by combustion of the gas-air mixture. The incandescent body is manufactured as a sheet material formed of a multiplicity of threads and connecting elements that at least indirectly connect the threads to one another. The connecting elements at least partially engage around the threads and thus connect them at least indirectly to one another. The connecting elements are configured in such a way that they may be detached from the connection with the threads, preferably by hand, while breaking up the sheet material.

20 Claims, 2 Drawing Sheets

(52) U.S. Cl.
CPC .. *F23D 2203/005* (2013.01); *F23D 2212/005* (2013.01); *F23D 2212/103* (2013.01); *F23D 2213/00* (2013.01)

(58) Field of Classification Search
USPC ..... 431/329
See application file for complete search history.

(56) References Cited

U.S. PATENT DOCUMENTS

| | | | | | |
|---|---|---|---|---|---|
| 2,361,164 | A | * | 10/1944 | Arthur | E01C 9/083 404/36 |
| 2,668,364 | A | | 2/1954 | Colton | |
| 3,144,073 | A | * | 8/1964 | Corey | F23D 14/58 431/329 |
| 3,200,874 | A | * | 8/1965 | Koppel | F23D 14/14 431/329 |
| 3,258,058 | A | | 6/1966 | Lherault et al. | |
| 3,529,916 | A | * | 9/1970 | Krieger | F23D 14/14 431/329 |
| 5,326,257 | A | | 7/1994 | Taylor et al. | |
| 5,571,009 | A | * | 11/1996 | StÅlhane et al. | F24C 3/047 431/328 |
| 5,699,680 | A | | 12/1997 | Guerlet et al. | |
| 6,190,162 | B1 | | 2/2001 | Smith et al. | |
| 2011/0111356 | A1 | | 5/2011 | Claerbout et al. | |
| 2013/0273485 | A1 | | 10/2013 | Lenoir et al. | |
| 2014/0000534 | A1 | | 1/2014 | Naitoh et al. | |

* cited by examiner

INFRARED RADIATOR AND METHOD OF ASSEMBLING SAME

BACKGROUND OF THE INVENTION

Field of the Invention

The invention relates to an infrared radiator as well as a method of assembling such a radiator, specifically according to the independent claims.

Generic infrared radiators are used in drying arrangements for heat treatment, such as drying a material web, for example a paper, tissue or cardboard web. These drying arrangements are part of machines for manufacturing and/or treating such material webs. Nonwoven glass fabrics would also be possible. A preferred area of application is the drying of moving paper, tissue or cardboard webs in paper mills, for example behind coating devices, viewed along the running direction of the material web.

Infrared radiators that are known in the art have for example a plurality of rods that are preferably arranged in one plane, i.e. that are coplanar. "However, arranging the rods in a plurality of parallel planes arranged at a distance from a burner plate is also known. The rods of generic infrared radiators are made of ceramic. Infrared radiators of this kind may be gas-powered. A burner is then associated with them. This burner is operated with a gas-air mixture. The burner has a burner plate that is charged with the gas-air mixture. The gas-air mixture is ignited for example using an electrode. The resulting flame heats the rods. The rods serve as incandescent bodies. They transfer the heat to the material web in the form of infrared radiation. Instead of rods, highly heat-resistant metals, for example in the form of grids or porous ceramics, have also become known as incandescent bodies.

Infrared radiators of this kind are used as surface radiators in the heat treatment of material webs. For this purpose, a multiplicity of such infrared radiators are arranged next to each other along the width and/or length of the material web to be treated. The required number of radiators is selected based on the width of the material web to be dried and the desired heating power. Using such infrared radiators, surface temperatures of 1100° C. and above may be achieved on the incandescent body.

A drawback of infrared radiators known from the prior art is that their radiation efficiency is not optimal for every application. It has also been shown that the gas-powered infrared radiators that are known in the art produce a very high proportion of nitrogen oxides (NOx) and carbon monoxides (CO) from the combustion of the gas-air mixture.

In addition, previous incandescent bodies made from ceramic components such as rods may cause the entire rod to fall onto the material web in the event of a break, which may damage the machine.

The present invention relates to the above-discussed subject matter.

SUMMARY OF THE INVENTION

The object of the invention is to create an infrared radiator and a method of assembling such a radiator that is improved over the prior art. In particular, the radiation efficiency and the exhaust gas behavior of the infrared radiator with regard to nitrogen oxides and carbon monoxide should be improved. Also, in the event of a possible break of the incandescent body, parts of the incandescent body should not fall onto the material web and the associated machine damage and downtime should be prevented.

This object is accomplished by an infrared radiator and a method according to the features of the independent claims.

The term "radiation efficiency" refers to the ratio of the power the infrared radiator supplies to the power it radiates—here, in the form of infrared radiation.

An infrared radiator according to the present invention dries a material web, for example in the intended operation (operating state) of the drying arrangement or the machine. This is the state in which the gas-air mixture within the infrared radiator burns and simultaneously heats the (at least one) incandescent body. Combustion may take place in the space bounded by the burner plate and at least one incandescent body—in this case referred to as the combustion chamber.

An incandescent body, in the sense of the present invention, is thus the object through which the gas-air mixture or its combustion products flow, and which is heated as a result of the combustion of the gas-air mixture. It is the part of the infrared radiator that glows due to being heated. Incandescence refers to the emission of radiation that is visible to the human eye. The incandescent body may be that part of the infrared radiator arranged behind the burner plate in the flow direction of the gas-air mixture. It may be at a distance from or in contact with the burner plate. The incandescent body is thus heated by the flames that are generated as a result of the combustion process, for example, on the side of the burner plate facing the incandescent body. The incandescent body could also be said to comprise all those elements that, together with the burner plate, delimit the combustion chamber of the infrared radiator. The at least one incandescent body may represent the outermost surface of the infrared radiator, which is directly opposite the material web to be treated. In such a case, the incandescent body is then arranged between the burner plate and the material web.

As used in the present invention, a "sheet material" is a planar structure such as woven fabric, knitted fabric, crocheted fabric, braided fabric or lace structures. Sheet materials are basically made up of a multiplicity of linear structures such as threads. In such sheet materials, the linear structures form or delimit openings of the sheet material. The sheet material could also be said to be designed in the manner of a net or grid, with the openings representing the interstices of the net or grid. These openings—in a top view of such a sheet material—may take on different geometric shapes, such as polygons, for example rhombuses, rectangles or hexagons. The planar extension of such openings is measured in length and width in the aforementioned top view. Taken together, the openings represent the cavity of the incandescent body and are flowed to or through by the gas-air mixture or the combustion products thereof during operation of the infrared radiator.

"Woven fabric" refers to a sheet material woven from warp and weft threads. These warp and weft threads cross each other. The woven fabric may comprise one or a plurality of different thread systems, preferably a plurality having different mechanical properties. But it is also possible that such woven fabrics may be used in which the warp and weft threads are made of the same material. Threads or connecting elements that serve as warp and weft threads touch each other at the intersections.

A knitted or crocheted fabric may be meshware. The term meshware is understood to mean such sheet materials in which a loop formed by a thread is interlaced with another loop. Knitted fabrics may be obtained, for example, by knitting or crocheting, with each mesh row being made up of a single thread, mesh by mesh. Knitted fabrics consist of one or more thread systems. A loop then engages in the loop of the preceding mesh row. In crocheted fabrics, on the other hand, at least two thread systems are used and the meshes of one mesh row are formed simultaneously. The loops define the intersection points at which the threads touch each other and the connecting elements touch the threads.

The term braid refers to an entanglement or interlacing between the connecting element and, for example, two threads directly adjacent to it. The threads as well as the connecting elements may be spiral-shaped. The self-supporting sheet material is then generated by interlacing the spirals. This may be achieved, for example, by twisting a connecting element lengthwise into a thread so that both spirals interlace with each other and touch at the intersection points. The longitudinal central axes of the spirals then lie parallel to each other in this sheet material. This is referred to as a spiral braid.

In principle, a distinction is made as to whether the sheet materials are capable of supporting themselves after they are produced. This applies to the structures mentioned above, with the exception of scrims. Scrims are also sheet materials that consist of one or more layers of parallel threads. However, these threads are not fixed to each other at their intersection points in a material-fit, force-fit or positive-fit manner. Such a scrim is therefore not self-supporting, i.e. when moved, it loses the shape it has been given. In order for it to retain its shape, the threads laid on top of each other must be held by force. Accordingly, when the infrared radiator according to the invention is ready for operation, the incandescent body is not designed as a scrim. Therefore for the purposes of the invention, scrims should not fall under the concept of a sheet material, i.e. should be free of such a structure. Scrims as intermediate products could be protected by the invention as long as they are subsequently processed in such a way that they are fixed to each other, for example, at their intersection points. An example in which a woven fabric is made from a scrim is examined in greater detail in the drawings and should fall within the scope of the invention.

In other words, for the purpose of the present invention, sheet materials exhibit repetitive, preferably regular patterns formed by the threads. In contrast, nonwovens are a random arrangement of fibers that are interlaced with each other or held together by a binder. Therefore, nonwovens do not fall under the term "sheet material" according to the present invention, and thus a nonwoven expressly does not constitute a sheet material. The advantage of using regular pattern-forming sheet materials is that over the entire extension of the sheet material a uniform combustion and thus a uniform exhaust gas behavior takes place when the sheet material is used as an incandescent body.

For purposes of the invention, the term "thread" refers to a linear, long, thin structure. Such a thread is much longer than it is wide, i.e. the diameter of the thread may be between 1 and 10 mm and the thread may have a length up to 300 mm. The thread may be made of a flexurally rigid material, i.e. a material with comparatively high flexural rigidity such as a ceramic. The term "flexural rigidity" refers to the product of the elastic modulus with the corresponding geometric moment of inertia. For example, a material having a comparatively higher elastic modulus, or a thread made therefrom, is more flexurally rigid than another thread with the same geometric moment of inertia. The term elastic modulus refers to a material characteristic used in materials engineering that describes the relationship between stress and elongation during the deformation of a solid body with linear-elastic behavior. The geometric moment of inertia is related to the cross-sectional area of the thread perpendicular to the longitudinal extension thereof. For purposes of the invention, a long and thin thread as described above is flexurally rigid if it does not change its embossed outer contour as soon as it is removed from the sheet material with at least partial dissolution of the sheet material. Nonrigid threads may be processed into sheet materials by the methods mentioned above, such as weaving or knitting, because the thread is flexible and its outer contour may be freely shaped during the process. On the other hand, flexurally rigid threads cannot be processed by such methods without changing or destroying their outer contour. For this reason, these sheet materials must alternatively for example be built up thread by thread, by joining them together by hand, by the method according to the invention. For this purpose, a plurality of (flexurally rigid) threads are initially furnished, the outer contour of which is predetermined. The threads are then connected to each other by connecting elements. At least one connecting element engages at least indirectly into two adjacent threads and connects these at the intersection points, for example, in an articulating manner. The joints are accordingly formed at the intersection points of the threads with the connecting elements. Such an articulated connection makes it possible for the threads of the self-supporting sheet material to move relative to each other. Thus the individual threads may expand differently to each other within the sheet material during heat input.

For purposes of the invention, "connecting elements" refers to structures that connect threads with each other at least indirectly, to produce a self-supporting sheet material. This latter term denotes both alternatives: with mediation, i.e. indirectly, and immediately, i.e. directly. In the first case, the threads are connected indirectly via the connecting element (directly adjacent thereto) if the connecting element itself does not engage in these two threads, but rather via additional threads. An example of this is woven fabric or meshware. In the second case, a connecting element engages in both threads directly adjacent to it and forms a plurality of intersection points (or articulated connections) with them. This is the case for a spiral fabric: Here, a connecting element always alternates with a thread.

Such connecting elements may be designed in such a way that they form a positive and/or nonpositive fit between the threads to be connected (or between each other). A positive fit is achieved when the connecting elements at least partially encompass themselves or the threads, as is the case with the formation of the intersection points. In principle, the connecting element could connect the threads positively, in the manner of a snap closure. It may be advantageous if the connection between the connecting element and the thread is detachable. Then individual threads or connecting elements within the sheet material may be removed and replaced without the need to recreate the entire sheet material. The connection should preferably be non-destructively detachable. This is the case if at least the thread (or the connecting element) is not changed or destroyed in the outer contour that it has within the sheet material. A non-destructively detachable connection has the advantage that the sheet material may be restored after its disassembly (in reverse order to this).

The connecting elements themselves may be designed as threads.

If the connection may be released and reconnected by hand, little force is required to join it. The connection in this case may also be freely disconnected and re-created using a tool.

The connection, i.e. the positive fit, may be designed in such a way that the threads cannot fall out of the connecting elements during operation of the infrared radiator, and thus they are held in the connecting elements in such a way that they cannot be lost. Thus, a self-supporting sheet material is achieved at all times during the operation of the infrared radiator.

For the purpose of the invention, a "material web" is a fibrous web, i.e. a scrim or tangle of fibers such as cellulose fibers, plastic fibers, glass fibers, carbon fibers, additives, admixtures or the like. For example, the material web may be a paper web, cardboard web or tissue web. The web may substantially comprise cellulose fibers, with small quantities of other fibers or additives and admixtures being present. This adaptation to a particular application is left to the skilled person.

References to the flow direction of the gas-air mixture in the invention refer to the main flow direction of the particles of the gas-air mixture. This direction corresponds, for example, to a perpendicular to the largest surface of the burner plate of the infrared radiator through which the gas-air mixture flows (the flow-receiving surface of the burner plate). The flow-receiving surface may therefore be at least one delimiting side, i.e. the surface spanned by the spatial length and width of the burner plate. The delimiting side may be spanned by the long and wide edges (of the flow-receiving surface) of the burner plate. Thus, the gas-air mixture may flow through the burner plate at the largest delimiting surface thereof that faces the gas supply or the premixing chamber. If the burner plate is designed as a cuboid, the flow-receiving surface is at least one side face of the cuboid. Because the incandescent body or its envelope may also be designed as a cuboid, the flow-receiving surface of the incandescent body is also a side face (delimiting surface) of the cuboid, which represents a flat surface. Therefore, the above definition also applies analogously to the incandescent body and its flow-receiving surface. Thus the incandescent body is also flowed along this flow-receiving surface together with the gas-air mixture or the combustion products thereof. The flow direction of the gas-air mixture may also be perpendicular to the largest delimiting surface or flow-receiving surface. The flow direction of the gas-air mixture through the incandescent body may be the same as the flow direction through the burner plate. The flow-receiving surface of the incandescent body may be identical to the flow-receiving surface of the burner plate, so that both have the same area. It may be the surface that the incandescent body and the burner plate share when they abut one another directly.

When reference is made in the present invention to one element directly abutting another element, this means that the two elements are in direct contact with each other without anything else—and, preferably, without any distance—between them.

If the invention refers to ceramic, this is understood as a technical ceramic. Examples of this include, for example, silicon carbide and molybdenum silicide. High-temperature-resistant metals such as FeCrAl compounds or heat conductor alloys would also be suitable, in principle, as materials for incandescent bodies.

If reference is made to the incandescent body being made of a plurality of layers arranged one above the other, this means that a plurality of layers of sheet materials may also be provided that are arranged one behind the other in the flow direction of the gas-air mixture. This means that the layers are stacked one above the other, when viewed in the flow direction of the gas-air mixture. This affords, according to the invention, the advantage that the exhaust gas values may be further improved.

The term "at least partially" refers to at least a part of the incandescent body.

If reference is made to one element surrounding another at least partially, this means that it either partially or completely surrounds or envelops the corresponding element.

The term "primary forming" means that the relevant element has been manufactured by a manufacturing process in which a solid body is generated from a formless substance. Examples of this are casting, sintering, 3D printing.

The present invention also relates to a method of assembling an infrared radiator according to the invention. Assembly may be performed in the ascending sequence of steps a) and b) as claimed. A corresponding disassembly may be carried out in the opposite sequence. When such an incandescent body is repaired, the sheet material may first be dissolved by disassembling the relevant elements to be replaced, such as threads and connecting elements, and may then be restored by assembling the replacement threads or connecting elements.

Furthermore, the invention relates to a drying arrangement for heat treatment of a material web, comprising an infrared dryer that has a plurality of infrared radiators according to the invention, preferably arranged in the width and/or length direction of the material web to be treated. Such a drying arrangement may have at least one air dryer for directing hot air and/or a combustion product of the gas-air mixture from the plurality of infrared radiators onto the material web to be treated. In addition, the at least one air dryer and the at least one infrared dryer may be arranged one behind the other as seen in the running direction of the material web to be treated, and the at least one infrared dryer may preferably be connected upstream of the at least one air dryer as viewed in the running direction of the material web to be treated.

The invention also relates to the incandescent body as claimed, as well as such a body having the features of the dependent claims.

Finally, the invention relates to a machine for manufacturing and/or treating a material web, preferably a paper machine, comprising at least one infrared radiator according to the invention, or such a drying arrangement.

BRIEF DESCRIPTION OF THE SEVERAL VIEWS OF THE DRAWING

The invention is described in greater detail below with reference to the drawings, without restricting the invention's generality. The drawings show the following.

DESCRIPTION OF THE INVENTION

Figure 1:
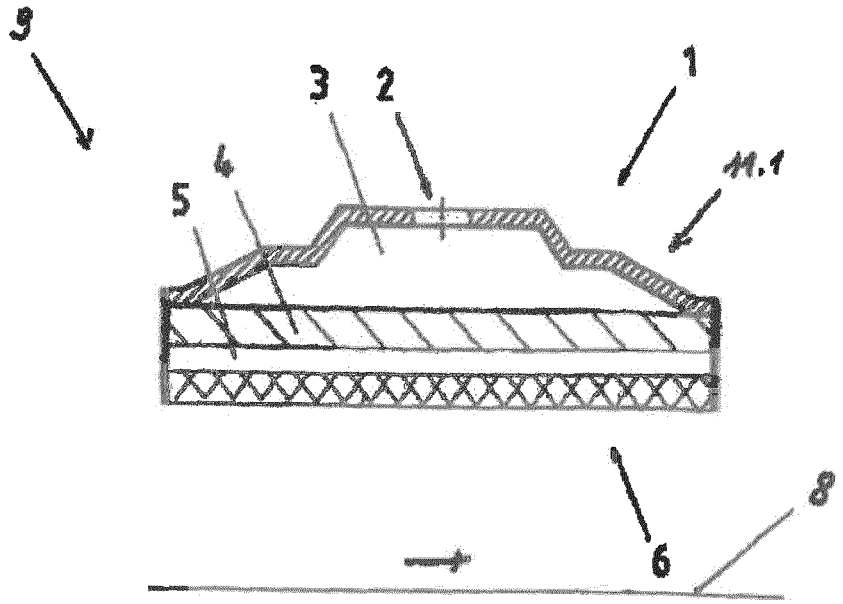
FIG. 1 a schematic, partially cut-away and not-to-scale representation of one embodiment of an infrared radiator.

FIG. 1 shows an exemplary embodiment of the invention in a schematic, partially cut-away view through a plane that is perpendicular to the material web and parallel to the running direction (indicated by the arrow). The drawing shows an infrared radiator 1, which may be part of a drying arrangement (see FIG. 2). During normal operation, the infrared radiator 1 is arranged at a distance from the material web 8, for example above it. The radiator forms a burner that is arranged in a housing 11.1. This housing has, for example, a rear wall and a plurality of side walls. The rear wall is located on the side (rear side) of the infrared radiator 1 facing away from the material web 8. An opening 2 is provided in this wall, through which a fuel, for example gas and air (an ignitable, combustible gas-air mixture) may enter a mixing chamber 3. The corresponding supply lines outside the infrared radiator 1 are not shown in detail. The mixing chamber 3 is delimited on one side by a gas-permeable burner plate 4 and on the other side by the housing 11.1, here the rear wall thereof. The gas-air mixture flows into the burner plate 4 at a flow-receiving surface corresponding to the rear side of the infrared radiator 1 and passes through the gas-permeable burner plate 4, to be combusted. From there the mixture flows into a combustion chamber 5. This chamber is delimited or formed jointly by the burner plate 4 and an incandescent body 6. The gas-permeable burner plate 4 may be said to separate the mixing chamber 3 from the combustion chamber 5. In the latter chamber, the gas-air mixture ignites. The heat released heats the incandescent body 6 until this body begins to glow. As a result, the body emits infrared rays toward the material web 8 to be dried. Both the burner plate 4 and the incandescent body 6 have a slab-shaped or cuboidal outer contour. In principle, a different outer contour would be possible. In this case, the flow-receiving surface of the incandescent body 6 corresponds to the flow-receiving surface of the burner plate 4. In other words, the two flow-receiving surfaces are the same. They correspond in this case to the clear width of the housing 11.1 that accommodates both the burner plate 4 and the incandescent body 6.

Irrespective of the embodiment shown, the infrared radiator 1 with its incandescent body 6 faces the material web 8; in the case shown, it does so in such a way that the incandescent body 6 runs parallel thereto. However, this need not necessarily be the case. The infrared radiator 1 may also run at an angle thereto. As shown in FIG. 1, the burner plate 4 and the incandescent body 6 are connected in series, viewed in the flow direction of the gas-air mixture. The incandescent body 6 is arranged downstream of the burner plate 4.

According to the embodiment of FIG. 1, the incandescent body 6 is designed as a gas-permeable regular grid. This grid may be formed by at least one sheet material. This structure is made up of a multiplicity of threads that delimit the openings of the grid. Consequently, the gas-air mixture passing through the burner plate 4 may also flow through all openings of the incandescent body 6 (simultaneously).

The incandescent body 6 is arranged at a distance from the burner plate 4, viewed in the flow direction of the gas-air mixture or the combustion products thereof. In other words, the combustion chamber 5 is formed by the space jointly delimited by the burner plate 4 and the incandescent body 6. The burner plate 4 and incandescent body 6 are arranged parallel to each other with regard to their flow-receiving surfaces or delimiting sides.

Although not shown in the drawings, it would be possible for the incandescent body 6 to directly abut the burner plate 4. This means that both are arranged without distance from each other and preferably parallel to each other.

Irrespective of the embodiment shown, it would be conceivable in principle, for example to provide a plurality of layers of an incandescent body 6, or more precisely several layers of sheet materials, which could be arranged at a distance from the burner plate 4 in the flow direction of the gas-air mixture or the resulting combustion products.

Figure 2A:
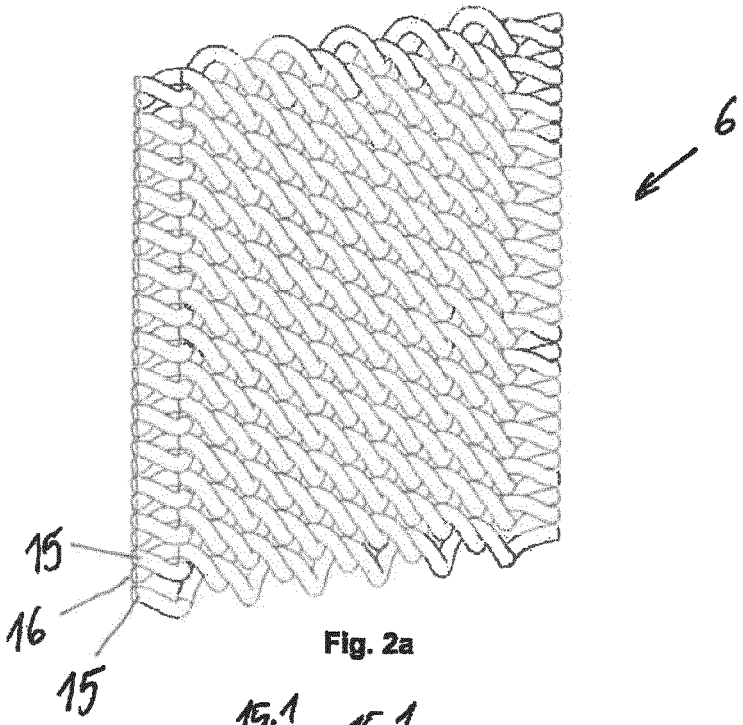
FIGS. 2*a* and 2*b* spatial representation of two respectively different embodiments of the incandescent bodies according to the invention.
Figure 2B:
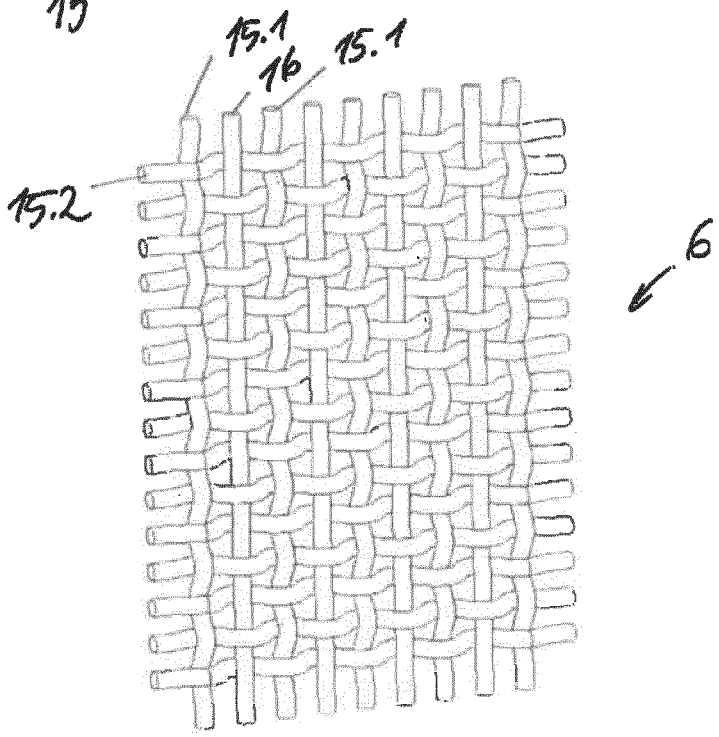

FIGS. 2*a* and 2*b* respectively show a spatial representation of two different embodiments of the incandescent body 6 according to the invention as a sheet material.

The sheet materials are formed from a multiplicity of threads 15 and connecting elements 16. Both incandescent bodies 6 are designed in such a way that the sheet materials may be both assembled and disassembled by hand without destroying individual threads 15 or connecting elements 16 in the process.

According to the embodiment of FIG. 2*a*, the sheet material is designed as a spiral braid. In addition, the threads 15 and the connecting elements 16 are identical, in the form of spirals. Both the longitudinal central axes of the threads 15 and those of the connecting elements 16 run parallel to each other over the entire spatial extent of the resulting sheet material. Threads 15 that are directly adjacent to one another (i.e. the threads 15 respectively arranged to the left and right of each connecting element 16) are thus each connected to a connecting element 16, which is likewise designed as a thread, in such a way that the spirals thereof are screwed into one another. Connecting elements 16 and threads 15 are respectively mounted to each other in an articulated manner at the shared intersection points.

This interlocking of the connecting elements 16 and threads 15 results in a loss-proof structure. This is because the direction of assembly or disassembly here runs in the direction of the longitudinal central axes of the connecting elements 16 and threads 15. This direction lies in the plane spanned by the sheet material, which here is also parallel to the material web 8. If the respective abutting ends of the outer contour of the resulting sheet material or incandescent body 6 are held in the housing 11.1 of the infrared radiator 1, they are prevented from falling out in the direction perpendicular to the material web 8.

The embodiment of FIG. 2*b* shows an incandescent body 6 in the form of a woven sheet material. Here, two directly adjacent threads 15.1 that are designed as weft threads weave the same weaving path through the warp threads, perpendicular to threads 15.2 that act as warp threads. A respective connecting element 16, which is likewise designed as a thread, is in this case arranged between mutually-adjacent threads 15.1. While the threads 15.1 and 15.2 have an undulating outer contour, the outer contour of the connecting elements 16 follows a straight line.

Irrespective of the embodiment shown, the threads 15 as well as the connecting elements 16 may be made of a comparatively flexurally rigid material, such as a ceramic. In this case, threads 15 and/or connecting elements 16 may be produced individually by primary forming. In this case, the methods mentioned above for manufacturing such sheet materials, such as weaving, may no longer be used. In this case, the sheet material must be assembled individually by hand, i.e. thread by thread, connecting element by connecting element. According to the embodiment of FIG. 2*b*, the threads 15.1 and 15.2, which serve as weft threads and warp threads, are laid crosswise, for example over the desired width. In the above example, this is done in the manner of a plain weave. Consequently, first, mutually-adjacent threads 15.1 that serve as weft threads take the same weaving path through the warp threads 15.2, i.e. both are alternately above and in turn below the threads 15.2 that serve as warp threads. In contrast, directly adjacent threads 15.2 that serve as warp threads always weave a mutually-different weaving path through the threads 15.1 that are designed as weft threads: While one thread 15.2 runs above the corresponding thread 15.1, the thread 15.2 directly adjacent thereto weaves below the corresponding thread 15.1.

Put differently, during assembly, the threads 15.1 and 15.2, without the connecting elements 16, initially form a scrim together. In the next step, a respective connecting element 16 is inserted—between two neighbors—into each of the cavities formed jointly by the threads 15.2 that serve as warp threads, parallel to the threads 15.1 that serve as weft threads. These themselves become weft threads, in this case weft threads that are straight and not undulating. The respective connecting element 16 then indirectly interlocks the threads 15.1 and 15.2 that are designed as weft and warp threads. Put differently, the initial scrim becomes a self-supporting woven fabric. In this case, the assembly may be done by hand. Here, too, the assembly and disassembly plane lies in the extension plane of the incandescent body 6 and thus is parallel to the material web 8. This prevents individual threads 15 or connecting elements 16 from falling out toward the material web 8. Even if a thread 15 or connecting element 16 breaks, it is still sufficiently secured to the sheet material due to the multiplicity of intersection points, so that it is prevented from falling onto the material web 8. This applies analogously to the embodiment of FIG. 2*a*.

In principle, the connecting elements 16 could lock the threads 15.1 and 15.2 together in the manner of warp threads.

Irrespective of the embodiments shown, the increased surface area of the incandescent body 6 may considerably increase the radiation efficiency due to the wavy or spiral outer contour of the threads 15 or the connecting elements 16. This is achieved by increasing the surface area for the combustion of the gas-air mixture due to the selected outer contour, which results in a higher energy absorption from the combustion products of the gas-air mixture. This may also reduce the proportion of nitrogen oxides and carbon monoxide in the combustion products.

Figure 3:
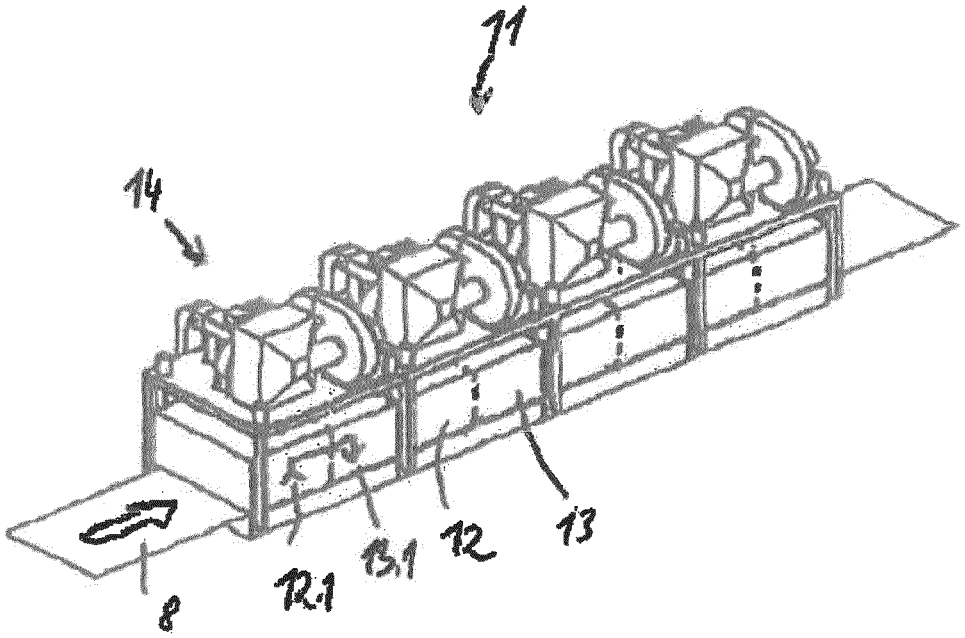
FIG. 3 a highly schematized representation of a drying arrangement in a three-dimensional view according to one embodiment.

FIG. 3 shows a possible embodiment of a drying arrangement 11 according to the invention. This may be part of a machine for manufacturing or treating a material web. The drying arrangement 11 here is arranged behind a coating or binder section (not shown) of the machine, in the running direction of the material web 8. Within this section, a coating color or binder is applied to the material web 8. As a result of this application, the material web 8 absorbs moisture and must therefore be dried, or the binder must be cured. This is done in the drying arrangement 11.

The drying arrangement 11 comprises one or, as shown here, a plurality of infrared dryers 12, each of which respectively has a multiplicity of infrared radiators 1 that serve as surface radiators and are preferably arranged parallel to the material web 8. In addition, the drying arrangement 11 also has a plurality of air dryers 13. In the present case, an infrared dryer 12 is respectively downstream of an air dryer 13 when viewed in the running direction of the material web 8, and so forth. Such an infrared dryer 12 and air dryer 13 are respectively referred to as a combination dryer 14. Four combination dryers 14 are furnished, arranged one behind the other in the running direction of the material web 8 to be dried. These combination dryers are, in this case, arranged directly abutting one another. Consequently, when the material web 8 to be dried leaves a first combination dryer 14, it immediately reaches the following combination dryer 14 viewed in the running direction. All combination dryers 14 are set up in such a way that, viewed in the running direction of the material web, drying occurs by infrared radiation from the associated infrared dryer 12, then by convection through the corresponding air dryer 13, by heat radiation and so on alternatingly. As soon as the material web 8 has left the first combination dryer 14 as viewed in the running direction of the web, it is transferred to the second combination dryer 14. There in turn, as viewed in its running direction, the web is first dried by the corresponding infrared dryer 12 and then by the corresponding air dryer 13. In other words, an air dryer 13 assigned to the first combination dryer 14 is arranged between an infrared dryer 12 of a first combination dryer 14 in the running direction and an infrared dryer 12 of another combination dryer 14 immediately following it in the running direction—viewed respectively in the running direction of the material web 8 through the drying arrangement 11. One could also say that the material web 8 is dried along the drying arrangement 11 alternatingly by heat radiation, then by convection, again in turn by heat radiation and so on.

The infrared dryer 12 of a respective combination dryer 14 may be designed as a gas-heated infrared dryer according to the invention. In this case, the infrared dryer 12 may comprise one or more infrared radiators 1 according to the invention (see FIG. 1). The combustion products (exhaust gases) that the infrared radiators 1 generate may then be extracted from the infrared dryer 12 via one or more suction nozzles 12.1 associated with the infrared dryer 12, only one of which is indicated here in a purely schematic manner. The at least one suction nozzle 12.1 may be arranged inside a housing that surrounds the infrared dryer 12.

The respective air dryer 13 may comprise one or more blowing nozzles 13.1, of which only one is shown here, likewise in a purely schematic manner. The at least one blowing nozzle 13.1 serves, among other things, to supply heated air to the material web 8 for drying. For this purpose, the at least one blowing nozzle 13.1 may be connected to a fresh air supply (not shown) in a flow-conducting manner. In addition, a flow-conducting connection may be furnished between the at least one suction nozzle 12.1 and the at least one blowing nozzle 13.1 of the same combination dryer 14. The thermal energy contained in the exhaust gas of the infrared dryer 12 may be used to heat the fresh air or to dry the material web 8 using the thermal energy of the exhaust gas of the respective infrared dryer 12.

The invention claimed is:

1. An infrared radiator for the heat treatment of a material web, the infrared radiator comprising:

an incandescent body having a flow-receiving surface disposed to be impinged by a gas-air mixture supplied to the infrared radiator and to be heated by a combustion of the gas-air mixture;

said incandescent body being manufactured as a sheet material selected from the group consisting of a spiral braid and a woven sheet material formed of a multiplicity of threads and connecting elements that, at least indirectly, connect said threads to one another;

said connecting elements at least partially engaging around said threads and connecting said treads to one another at least indirectly;

said connecting elements being configured to enable a connection of said connecting elements with said threads to be detached while breaking up said sheet material;

said threads and said connecting elements of said spiral braid being substantially identical spirals; and said threads of said woven sheet material following an undulating outer contour while said connecting elements follow a substantially straight line.

2. The infrared radiator according to claim 1, wherein said connecting elements and said threads are detachable by hand for manually breaking up said sheet material.

3. The infrared radiator according to claim 1, wherein said connecting elements are configured to enable a reconnection thereof with said threads to thereby form the sheet material.

4. The infrared radiator according to claim 1, wherein at least one of said connecting elements or said threads is configured so that neither said connecting elements nor said threads are destroyed when said sheet material is either broken up or manufactured.

5. The infrared radiator according to claim 1, wherein said connecting elements are configured to hold said threads together in a loss-proof manner.

6. The infrared radiator according to claim 1, wherein individual said threads are configured for detachment from a connection between said threads by a longitudinal and/or rotary movement along a longitudinal axis thereof.

7. The infrared radiator according to claim 1, wherein said connecting elements are formed as threads, and both said connecting elements and said threads are formed spirally, thus defining the sheet material as a spiral braid, respectively such that a connecting element connects two directly adjacent threads to one another by engaging said directly adjacent threads into each other.

8. The infrared radiator according to claim 7, wherein said connecting elements are formed as threads having an identical outer contour to the threads that connect them.

9. The infrared radiator according to claim 1, wherein:

said sheet material is a woven fabric comprising threads serving as warp threads that are interwoven with threads serving as weft threads;

said connecting elements are threads being either warp threads or weft threads and said connecting elements are arranged respectively between two identical threads in the form of warp threads or weft threads; and said threads have a wave-shaped outer contour and said connecting elements have a rectilinear outer contour.

10. The infrared radiator according to claim 9, wherein the woven fabric is constructed in the manner of a plain weave, so that the directly adjacent threads that serve as weft threads weave alternately through the threads serving as warp threads, along different weaving paths.

11. The infrared radiator according to claim 1, wherein at least one of said threads or said connecting elements are made of a comparatively flexurally rigid material.

12. The infrared radiator according to claim 11, wherein said threads and/or said connecting elements are made of ceramic material.

13. The infrared radiator according to claim 1, wherein said flow-receiving surface is at least one delimiting side of said incandescent body.

14. The infrared radiator according to claim 1, wherein said infrared radiator has a burner plate and said incandescent body is arranged behind said burner plate in a flow direction of the gas-air mixture.

15. The infrared radiator according to claim 14, wherein said incandescent body directly adjoins said burner plate viewed in the flow direction of the gas-air mixture.

16. The infrared radiator according to claim 1, wherein said incandescent body is formed of a plurality of layers of said sheet material arranged on top of one another.

17. The infrared radiator according to claim 1, wherein at least one of said threads or said connecting elements are individually manufactured.

18. The infrared radiator according to claim 17, wherein said at least one of said threads or said connecting elements are manufactured by primary forming.

19. A method of assembling the infrared radiator according to claim 1, the method comprising the following steps:

a) providing individual threads and connecting elements;

b) at least indirectly connecting individual threads to one another with at least one connecting element in such a way that two directly adjacent threads are detachably interconnected directly or indirectly by engaging the connecting element in the threads to produce a sheet material.

20. The method according to claim 19, which comprises connecting the threads and the connecting element so that the sheet material may be disassembled by disconnecting the threads and the connecting element by hand.

* * * * *